US010290435B1

(12) United States Patent
Ambekar et al.

(10) Patent No.: US 10,290,435 B1
(45) Date of Patent: May 14, 2019

(54) MAGNETIC CIRCUIT ARRANGEMENT FOR AN ELECTRICAL SWITCH

(71) Applicant: EATON INTELLIGENT POWER LIMITED, Dublin (IE)

(72) Inventors: Vinaya A. Ambekar, Pune (IN); Joshua D. Myers, Fletcher, NC (US); Vikrant Deshmukh, Undri Junction (IN); Archit Agarwal, Rajasthan (IN); Mandar D. Anekar, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/921,133

(22) Filed: Mar. 14, 2018

(51) Int. Cl.

| | |
|---|---|
| ***H01H 3/00*** | (2006.01) |
| ***H01H 33/60*** | (2006.01) |
| ***H01H 33/59*** | (2006.01) |
| ***H01H 47/00*** | (2006.01) |

(52) U.S. Cl.
CPC ..... *H01H 3/001* (2013.01); *H01H 33/59* (2013.01); *H01H 33/60* (2013.01); *H01H 47/002* (2013.01); *H01H 2047/003* (2013.01); *H01H 2223/008* (2013.01); *H01H 2223/018* (2013.01)

(58) Field of Classification Search
CPC ..... H01H 3/001; H01H 47/002; H01H 33/59; H01H 33/60; H01H 2223/018; H01H 2223/008; H01H 2047/003
See application file for complete search history.

(56) References Cited

U.S. PATENT DOCUMENTS

| | | | | |
|---|---|---|---|---|
| 3,887,888 | A | 6/1975 | Bayles et al. | |
| 5,023,583 | A * | 6/1991 | Bratkowski | H01H 71/1081 335/16 |
| 5,959,517 | A | 9/1999 | Wieloch et al. | |
| 6,377,143 | B1 | 4/2002 | Zhou et al. | |
| 6,977,568 | B1 * | 12/2005 | Rakus | H01H 1/225 218/22 |
| 7,189,935 | B1 * | 3/2007 | Hassan | H01H 1/20 200/244 |
| 2002/0011908 | A1 * | 1/2002 | Kim | H01H 71/123 335/35 |
| 2003/0038695 | A1 * | 2/2003 | Kramer | H01H 1/5833 335/172 |
| 2003/0222739 | A1 * | 12/2003 | Kolberg | H01H 1/5822 335/35 |
| 2008/0191819 | A1 * | 8/2008 | Malingowski | H01H 77/108 335/16 |
| 2008/0218296 | A1 * | 9/2008 | Weister | H01H 77/107 335/12 |

(Continued)

*Primary Examiner* — Truc T Nguyen
(74) *Attorney, Agent, or Firm* — Squire Patton Boggs (US) LLP

(57) ABSTRACT

An electrical switch includes a fixed contact member and a plurality of movable contact fingers that pivot into and out of engagement with the fixed contact member. The electrical switch also includes a fixed magnetic member and a plurality of U-shaped magnetic members housing the plurality of movable contact fingers. Upon occurrence of a fault condition, each of the plurality of U-shaped magnetic members is magnetically pulled towards the fixed magnetic member, without contacting the fixed magnetic member, such that each of the plurality of movable contact fingers is held in engagement with the fixed contact member.

20 Claims, 4 Drawing Sheets

(56) References Cited

U.S. PATENT DOCUMENTS

| | | | | |
|---|---|---|---|---|
| 2014/0118096 | A1* | 5/2014 | Huang | H01H 71/2454<br>335/174 |
| 2014/0218140 | A1* | 8/2014 | Dolinski | H01H 1/42<br>335/196 |
| 2015/0090696 | A1* | 4/2015 | Mattlar | H01H 1/22<br>218/154 |

* cited by examiner

MAGNETIC CIRCUIT ARRANGEMENT FOR AN ELECTRICAL SWITCH

FIELD OF INVENTION

The present disclosure relates to an electrical switching device. More specifically, the present disclosure relates to a method and apparatus to prevent contact welding subsequent to fault conditions in an electromagnetic contactor of an electrical switching device.

BACKGROUND

Existing transfer switches may be used to transfer a power consuming load from a circuit with a normal power supply to a circuit with an auxiliary power supply. The transfer switches utilize either contactors or circuit breakers that are able to withstand a high current for switching loads. The transfer switch contactor has a set of contact arrangements to switch from one source to another. These contactors are usually operated by means of an operating mechanism that is mechanically linked to the contactor assembly.

Under short circuit conditions very high amperages are developed. Currents as high as 5,000 amperes may develop under some short circuit conditions, while under more severe and extraordinary conditions, currents as high as 20,000 amperes or in excess of that may occur.

In prior devices a pair of fixed contacts were bridged by a movable contact that was held in closed circuit condition by a spring pressure against the movable or bridging contact. Ordinarily, the fixed contact members and the bridging contact members as well as the contact surfaces themselves are massive and are held closed by relatively heavy springs which impose considerable pressure on the bridging contact to hold it in engagement with the fixed contacts.

On the occurrence of the short circuit current over a threshold amperage, contact pressure of the spring holding the bridging contact in engagement with the movable contact can be overcome by magnetic forces of repulsion developed between the stationary and movable contacts. When the spring bias is overcome, the contacts tend to separate. Contact separation under short circuit conditions results in arcing. This sometimes has resulted in a violent explosion in instances of a large fault. In less severe cases there may be a melting of small amounts of contact material, with the result that when the "short" was cleared, by a fuse, circuit breaker, or other protective device, the contacts would snap back together and the molten material would cool. This caused firm welding of the contacts together.

SUMMARY

In one embodiment, an electrical switch includes a fixed contact member and a fixed magnetic member associated with the fixed contact member. The electrical switch further includes a plurality of movable contact fingers configured to pivot into and out of engagement with the fixed contact member and a plurality of U-shaped magnetic members. Each of the plurality of U-shaped magnetic members houses at least one of the plurality of movable contact fingers. Upon occurrence of a short circuit, each of the plurality of U-shaped magnetic members is attracted to the fixed magnetic member, such that each of the plurality of movable contact fingers is held in engagement with the fixed contact member by a magnetic force proportional to a current flow through the plurality of movable contact fingers and the fixed contact member. The electrical switch also includes a plurality of biasing members. Each of the plurality of biasing members is in contact with one of the plurality of U-shaped magnetic members and at least one of the plurality of movable contact fingers. Each of the plurality of biasing members provides a biasing force that biases the plurality of U-shaped magnetic members away from the plurality of movable contact fingers.

In another embodiment, a method of preventing a contact weld in an electrical switch under a fault condition is provided. The method includes providing a fixed contact member, providing a fixed magnetic member, providing a plurality of movable contact fingers, and housing the plurality of movable contact fingers in a plurality of U-shaped magnetic members. The method further includes pivoting the plurality of movable contact fingers into contact with the fixed contact member and energizing a coil with an energy pulse reaching an activation power threshold source to create an electrical current path through the fixed contact member and the plurality of movable contact fingers. The method also includes permitting the plurality of U-shaped magnetic members to form a broken loop with the fixed magnetic member under a fault condition, which provides a concentrated flux path. The method further includes permitting attraction between the plurality of U-shaped magnetic members and the fixed magnetic member to maintain contact between the plurality of movable contact fingers and the fixed contact member.

In yet another embodiment, an electrical switch includes a fixed contact member and a plurality of movable contact fingers that pivot into and out of engagement with the fixed contact member. The electrical switch also includes a fixed magnetic member and a plurality of U-shaped magnetic members housing the plurality of movable contact fingers. Upon occurrence of a fault condition, each of the plurality of U-shaped magnetic members is magnetically pulled towards the fixed magnetic member, without contacting the fixed magnetic member, such that each of the plurality of movable contact fingers is held in engagement with the fixed contact member.

BRIEF DESCRIPTION OF THE DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1:
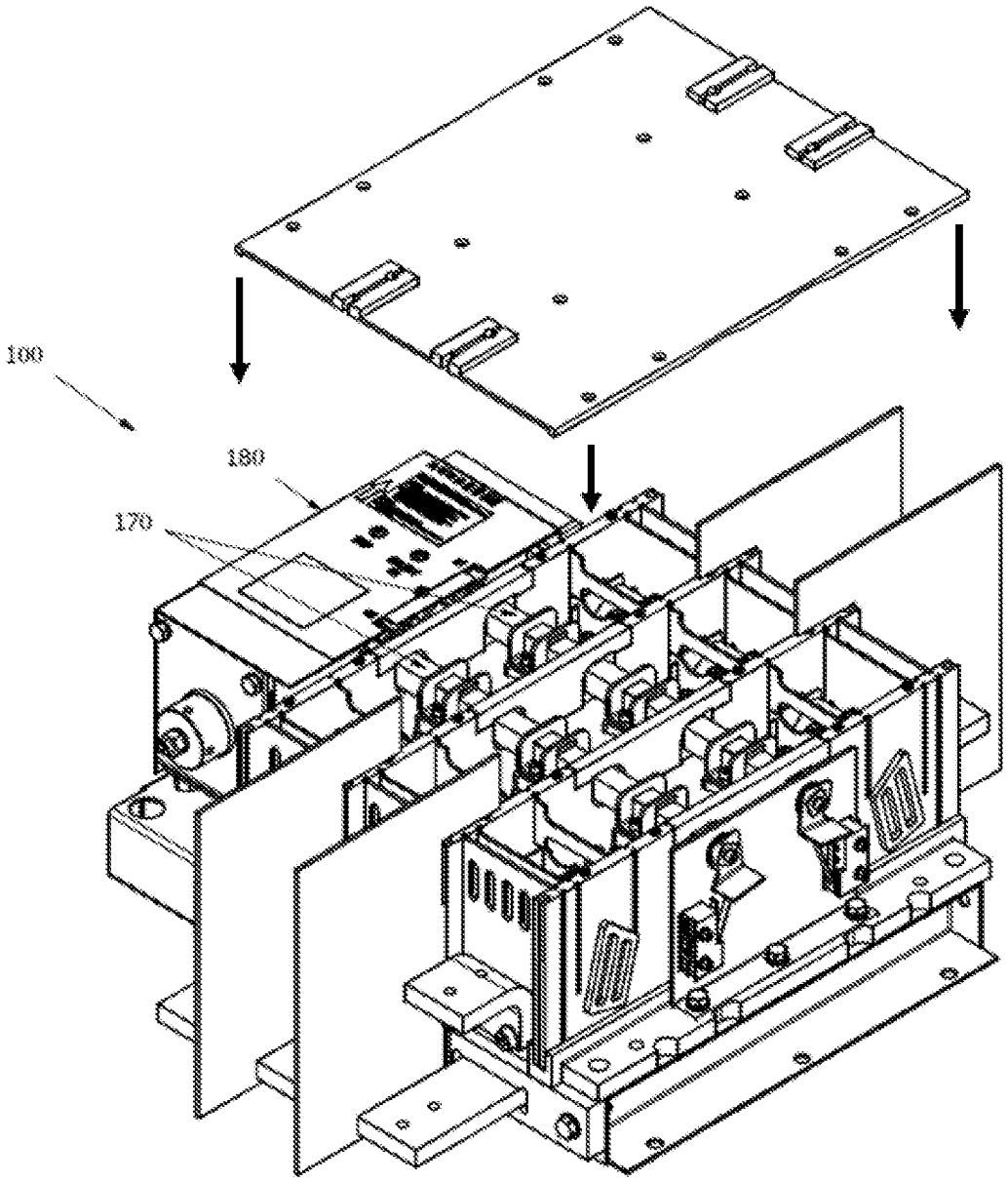
FIG. 1 is a perspective view of one embodiment of an electrical switching device.

FIG. 1 is a perspective view of one embodiment of an electrical switching device 100. The electrical switching device 100 includes an electromagnetic contactor for switching supply current to a motor or other load device.

Figure 2:
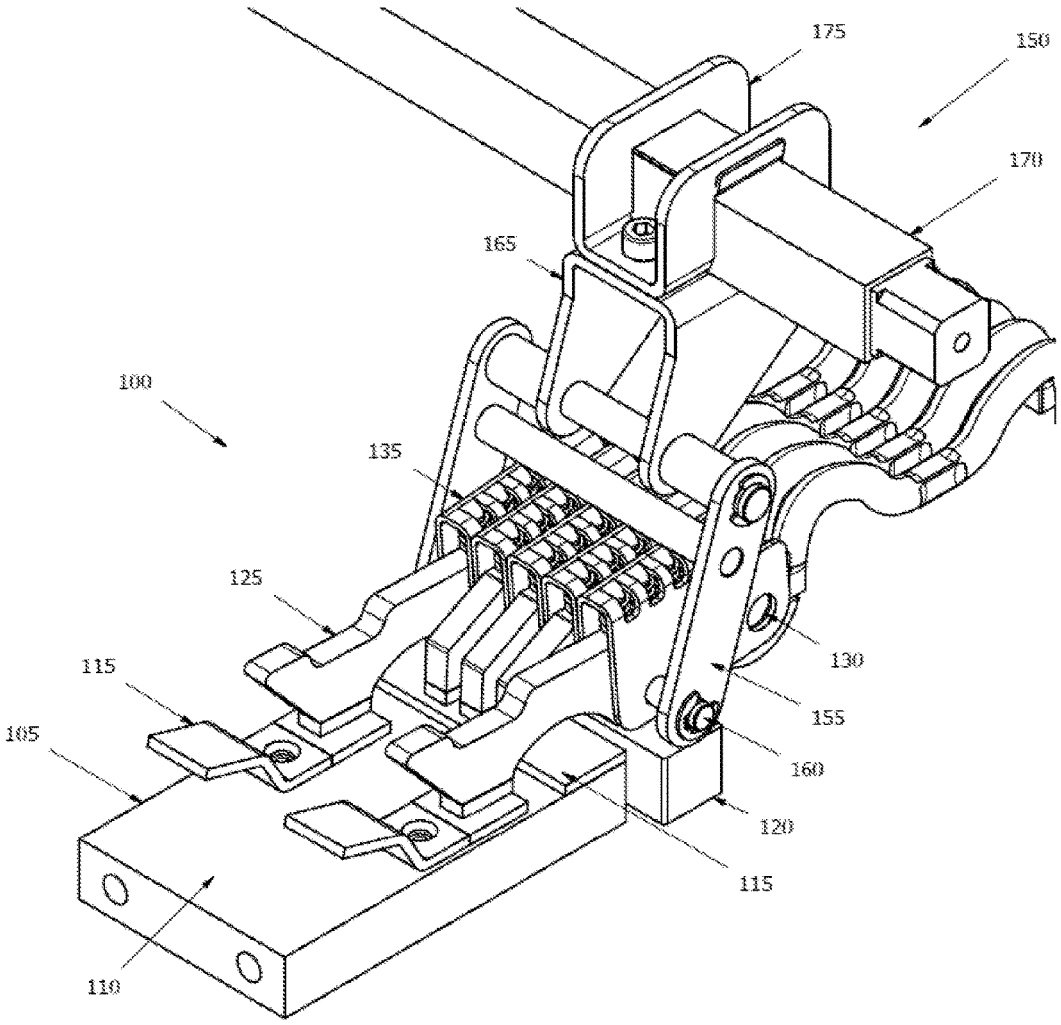
FIG. 2 is a close-up, perspective view of the fixed and movable components of the electrical switching device of FIG. 1.
Figure 3:
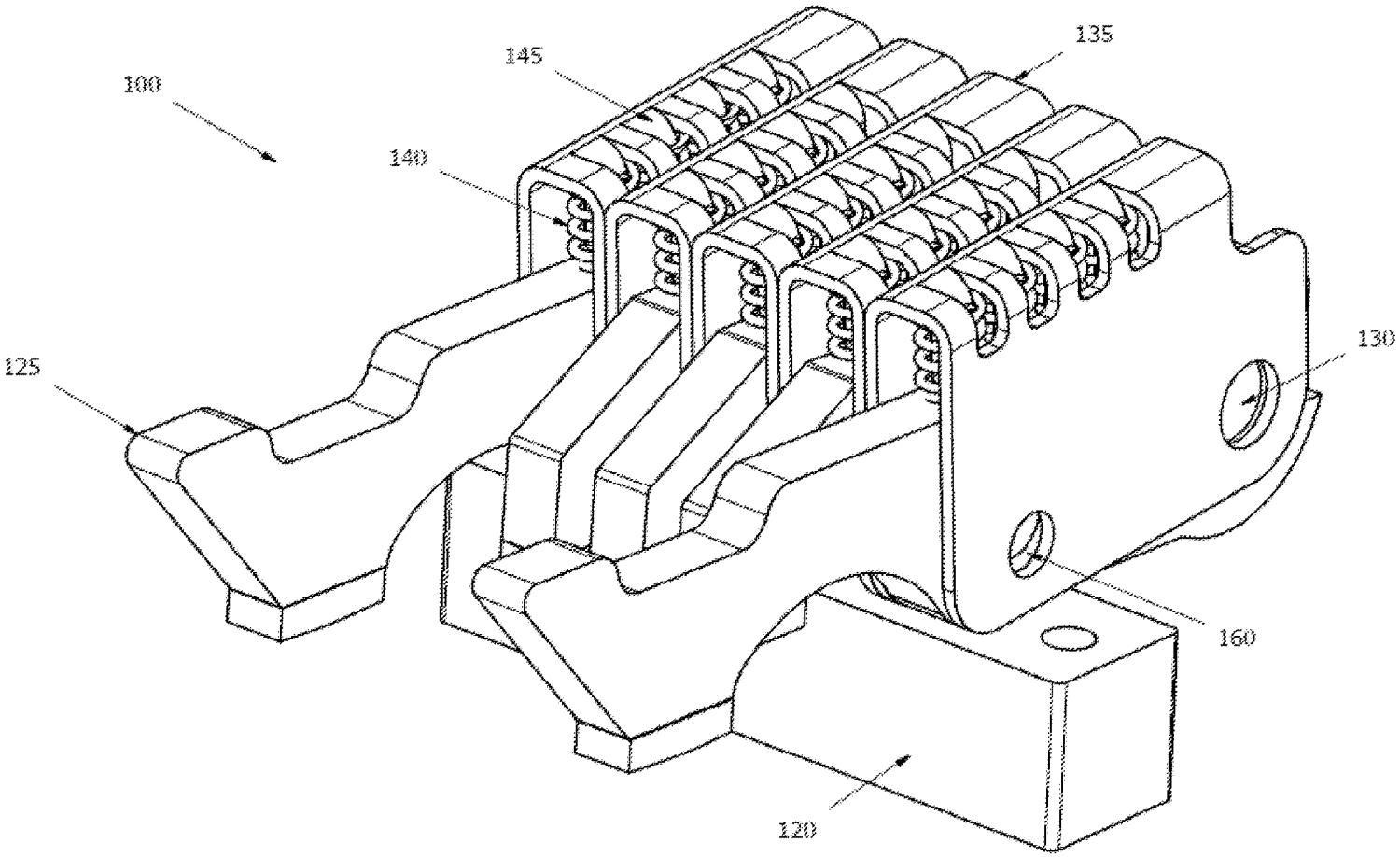
FIG. 3 is a close-up, perspective view of the movable components and a fixed magnetic component of the electrical switching device of FIG. 1.

FIG. 2 is a close-up, perspective view of the fixed and movable components of the electrical switching device 100. Additionally, FIG. 3 is a close-up, perspective view of the movable components of the electrical switching device 100. The fixed and movable components of the electrical switching device 100 will be described with reference to both FIGS. 3 and 4.

The electrical switching device 100 includes a fixed contact member 105. The fixed contact member 105 includes a base member 110 and electrical contacts 115. The fixed contact member 105 also has three electrical contacts 115, including a pair of forward contacts and one elongated rear contact. In alternative embodiments (not shown), any number of electrical contacts may be employed in any configuration.

In one embodiment, the electrical contacts 115 are connected to wires, busbars, or other electrically conductive materials to form an electrical pathway. In such an embodiment, the base member 110 may be an insulating base. In an alternative embodiment, the base member 110 may be an electrically conductive base that forms an electrical pathway.

The electrical switching device 100 further includes a fixed magnetic member 120 that is associated with the fixed contact member 105. In the illustrated embodiment, the fixed magnetic member 120 is adjacent to the fixed contact member 105. In such an embodiment, the fixed magnetic member 120 is spaced from the fixed contact member 105.

The electrical switching device 100 also includes a plurality of movable contact fingers 125. The movable contact fingers 125 are configured to pivot about a first pivot axis 130 into and out of engagement with the fixed contact member 105.

A plurality of U-shaped magnetic members 135 are also included in the electrical switching device 100. Each of the movable contact fingers 125 is partially disposed in one of the U-shaped magnetic members 135, such that the sides and the top of each movable contact finger 125 is surrounded by the U-shaped magnetic member 135, and the bottom of each movable contact finger 125 is exposed. In this arrangement, each U-shaped magnetic member 135 may be described as housing one of the movable contact fingers 125.

The U-shaped magnetic members 135 and the fixed magnetic member 120 may be made of material having high magnetic permeability (referred to generically as ferromagnetic material) which will not saturate in the presence of fault currents with an air gap present. As currents increase, the magnetic force tending to keep the contacts closed will likewise increase. One suitable material is cold rolled steel, but other materials having high permeability in the area of 8000 gausses, such as iron or other steels may be used.

In the illustrated embodiment, the electrical switching device 100 includes five movable contact fingers 125 and five U-shaped magnetic members 135, with each U-shaped magnetic member 135 housing a single movable contact finger 125. In alternative embodiments (not shown), any number of movable contact fingers and U-shaped magnetic members may be employed. In some such embodiments, a U-shaped magnetic member may house two or more movable contact members.

As can be seen in FIG. 3, in addition to housing a movable contact finger 125, each U-shaped magnetic member 135 also houses a plurality of compression springs 140. While each U-shaped member 135 is shown as housing four compression springs 140, it should be understood that any number of compression springs may be employed. In another alternative embodiment (not shown), other biasing members may be employed, such as rubber members.

In the illustrated embodiment, portions of each U-shaped magnetic member 135 are punched or cut and bent to form a plurality of internal extensions 145 that receive each compression spring 140. In an alternative embodiment (not shown), each U-shaped magnetic member has a plurality of posts or pins to receive each compression spring. Each compression spring 140 is thus in contact with one of the plurality of U-shaped magnetic members 135 and one of the movable contact fingers 125. Each compression spring 140 provides a biasing force that biases the U-shaped magnetic member 135 away from the movable contact finger 125, and likewise biases the movable contact finger 125 towards the fixed contact member 105.

During operation of the electrical switching device 100, a pivoting switch apparatus 150 causes the plurality of movable contact fingers 125 to pivot into contact with the fixed contact member 105. The pivoting switch apparatus includes a pivoting arm 155 that has a first end attached to the plurality of U-shaped magnetic members 135 at a second pivot point 160. A lever arm 165 is attached to a second end of the pivoting arm 155. The lever arm 165 is also connected to a crossbar 170 by a mounting bracket 175. In an alternative embodiment, the lever arm may be connected to the crossbar by other means, such as by being directly bolted, welded, or otherwise affixed to the crossbar.

The crossbar 170 may be rotated by an operating mechanism, such as the operating mechanism 180 shown in FIG. 1. Alternatively, the crossbar 170 may be manually rotated. When the crossbar 170 rotates the lever arm 165 to the rear, the U-shaped magnetic members 135 pivot downwards, causing the compression spring to bias the movable contact fingers 125 into contact with fixed contact member 105. Likewise, when the crossbar 170 rotates the lever arm 165 forwards, the U-shaped magnetic members 135 pivot upwards, allowing the movable contact fingers 125 to pivot out of contact with the fixed contact member 105.

When a short circuit or other fault condition occurs, each of the plurality of the U-shaped magnetic members 135 is attracted to the fixed magnetic member 120, such that each of the plurality of movable contact fingers 125 is held in contact with the fixed contact member 105 by a magnetic force proportional to a current flow through the plurality of movable contact fingers 125 and the fixed contact member 105. This magnetic force is in the same direction as the biasing force exerted by the compression springs 140. The U-shaped magnetic members 135 and the fixed magnetic member 120 do not touch, but remain spaced from each other. However, on occurrence of a short circuit, each of the plurality of the U-shaped magnetic members 135 forms a broken loop with the fixed magnetic member 120, which provides a concentrated flux path.

Figure 4:
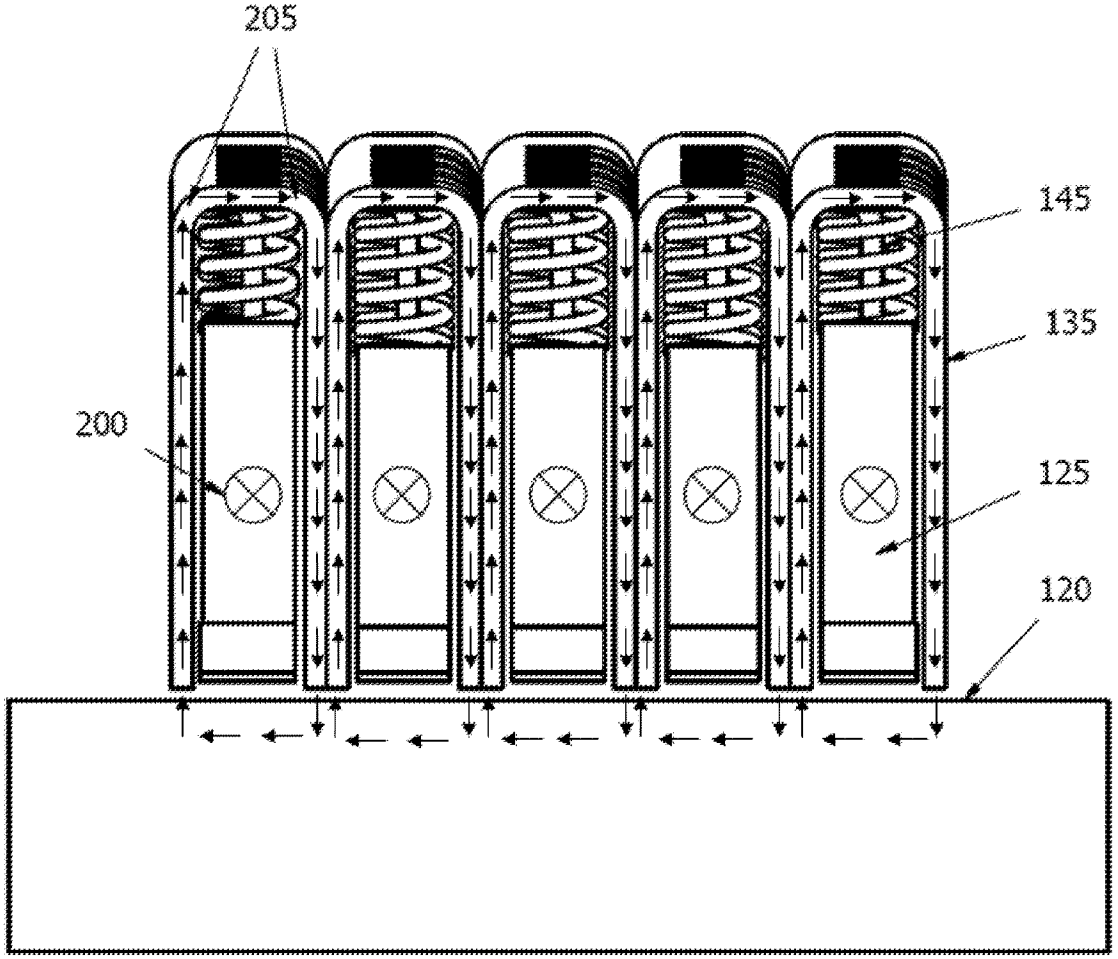
FIG. 4 is a cross-section of the movable components and a fixed magnetic component of the electrical switching device of FIG. 1.

FIG. 4 is a cross-section of the movable components and a fixed magnetic component of the electrical switching device 100. The electromagnetic paths of travel are illustrated in this view. As can be seen from this view, when a coil is energized with an energy pulse reaching an activation power threshold source, an electrical current path is created through the fixed contact member 105 and the plurality of movable contact fingers 125. The electric current 200 is shown flowing into the page through the movable contact fingers 125. This current induces a magnetic field in a clockwise direction, as shown by the flux lines 205.

When a high amperage occurs due to a short circuit or other fault condition, the strong magnetic field attracts the U-shaped magnetic members 135 towards the fixed magnetic member 120, overcoming the efforts of the currents to separate the contacts. The magnetic force generated by the fault current is utilized by adding the fixed magnetic member 120 below the U-shaped magnetic members 135. The arrangement is such that when the high amperage current passes through the magnetic structure, the attractive forces are generated to ensure that the contacts remain closed during short circuit faults.

In one embodiment, the magnetic force and the biasing force of the compression springs 140 are both maintained after the fault condition dissipates to continue the contact between the plurality of movable contact fingers 125 and the fixed contact member 105. In one specific embodiment, the plurality of movable contact fingers 125 and the fixed contact member 105 remain in contact to cool after the fault condition dissipates, before separating.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present disclosure has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the disclosure, in its broader aspects, is not limited to the specific details, the representative system and method, and illustrative examples shown and described. Accordingly, departures may be made from such details without departing from the spirit or scope of the applicant's general inventive concept.

What is claimed is:

1. An electrical switch comprising:

a fixed contact member;

a fixed magnetic member associated with the fixed contact member;

a plurality of movable contact fingers configured to pivot into and out of engagement with the fixed contact member;

a plurality of U-shaped magnetic members, wherein each of the plurality of U-shaped magnetic members houses at least one of the plurality of movable contact fingers, wherein on occurrence of a short circuit, each of the plurality of U-shaped magnetic members is attracted to the fixed magnetic member, such that each of the plurality of movable contact fingers is held in engagement with the fixed contact member by a magnetic force proportional to a current flow through the plurality of movable contact fingers and the fixed contact member; and a plurality of biasing members, wherein each of the plurality of biasing members is in contact with one of the plurality of U-shaped magnetic members and at least one of the plurality of movable contact fingers, and wherein each of the plurality of biasing members provides a biasing force that biases the plurality of U-shaped magnetic members away from the plurality of movable contact fingers.

2. The electrical switch of claim 1, wherein the biasing force biases the plurality of movable contact fingers towards the fixed contact member.

3. The electrical switch of claim 1, wherein on occurrence of the short circuit, the magnetic force is in the same direction as the biasing force.

4. The electrical switch of claim 1, wherein the fixed magnetic member is adjacent to the fixed contact member.

5. The electrical switch of claim 1, wherein each of the plurality of biasing members is a compression spring.

6. The electrical switch of claim 5, wherein each of the compression spring is housed in one of the plurality of U-shaped magnetic members.

7. The electrical switch of claim 1, wherein each of the plurality of U-shaped magnetic members houses at least two of the plurality of movable contact fingers.

8. The electrical switch of claim 1, wherein on occurrence of the short circuit, each of the plurality of U-shaped magnetic members is spaced from the fixed magnetic member.

9. The electrical switch of claim 8, wherein on occurrence of the short circuit, each of the plurality of U-shaped magnetic members forms a broken loop with the fixed magnetic member, which provides a concentrated flux path.

10. A method of preventing a contact weld in an electrical switch under a fault condition, the method comprising:

providing a fixed contact member;

providing a fixed magnetic member;

providing a plurality of movable contact fingers;

housing the plurality of movable contact fingers in a plurality of U-shaped magnetic members;

pivoting the plurality of movable contact fingers into contact with the fixed contact member;

energizing a coil with an energy pulse reaching an activation power threshold source to create an electrical current path through the fixed contact member and the plurality of movable contact fingers;

permitting the plurality of U-shaped magnetic members to form a broken loop with the fixed magnetic member under a fault condition, which provides a concentrated flux path; and permitting attraction between the plurality of U-shaped magnetic members and the fixed magnetic member to maintain contact between the plurality of movable contact fingers and the fixed contact member.

11. The method of claim 10, further comprising biasing the plurality of movable contact fingers towards the fixed contact member with a biasing member.

12. The method of claim 11, wherein the biasing member is a plurality of compression springs disposed between the plurality of movable contact fingers and the plurality of U-shaped magnetic members.

13. The method of claim 10, wherein the step of permitting attraction between the plurality of U-shaped magnetic members and the fixed magnetic member to maintain contact between the plurality of movable contact fingers and the fixed contact member includes maintaining a space between the plurality of U-shaped magnetic members and the fixed magnetic member.

14. The method of claim 10, further comprising maintaining a magnetic force to maintain contact between the plurality of movable contact fingers and the fixed contact member after the fault condition dissipates.

15. The method of claim 10, further comprising allowing the plurality of movable contact fingers and the fixed contact member sufficient time to cool after the fault condition dissipates, before separating the plurality of movable contact fingers and the fixed contact member.

16. An electrical switch comprising:

a fixed contact member;

a plurality of movable contact fingers that pivot into and out of engagement with the fixed contact member;

a fixed magnetic member; and a plurality of U-shaped magnetic members housing the plurality of movable contact fingers, wherein on occurrence of a fault condition, each of the plurality of U-shaped magnetic members is magnetically pulled towards the fixed magnetic member, without contacting the fixed magnetic member, such that each of the plurality of movable contact fingers is held in engagement with the fixed contact member.

17. The electrical switch of claim 16, further comprising a plurality of biasing members in contact with the plurality of U-shaped magnetic members and the plurality of movable contact fingers.

18. The electrical switch of claim 17, wherein the plurality of biasing members provides a biasing force that biases the U-shaped magnetic members away from the plurality of movable contact fingers.

19. The electrical switch of claim 17, wherein the plurality of biasing members provides a biasing force that biases the movable contact fingers towards the fixed contact member.

20. The electrical switch of claim 16, wherein each of the plurality of U-shaped magnetic members houses a single movable contact finger.

* * * * *